US010117483B2

(12) United States Patent
Fukui et al.

(10) Patent No.: US 10,117,483 B2
(45) Date of Patent: Nov. 6, 2018

(54) ACCESSORY/DECORATION THAT OPENS LIKE A FLOWER

(71) Applicants: Osamu Fukui, Tokyo (JP); Misako Fukui, Tokyo (JP)

(72) Inventors: Osamu Fukui, Tokyo (JP); Misako Fukui, Tokyo (JP)

( * ) Notice: Subject to any disclaimer, the term of this patent is extended or adjusted under 35 U.S.C. 154(b) by 147 days.

(21) Appl. No.: 15/399,669

(22) Filed: Jan. 5, 2017

(65) Prior Publication Data

US 2017/0112241 A1 Apr. 27, 2017

Related U.S. Application Data

(63) Continuation-in-part of application No. 14/786,214, filed on Oct. 22, 2015.

(30) Foreign Application Priority Data

Apr. 26, 2013 (JP) ..... 2013-093133

(51) Int. Cl.

| | |
|---|---|
| ***A44C 15/00*** | (2006.01) |
| ***A44C 17/02*** | (2006.01) |
| ***A44C 9/00*** | (2006.01) |
| *A41G 1/00* | (2006.01) |

(52) U.S. Cl.

CPC ..... *A44C 17/02* (2013.01); *A44C 9/0053* (2013.01); *A44C 17/0266* (2013.01); *A41G 1/002* (2013.01)

(58) Field of Classification Search

CPC ..... A44C 9/00; A44C 9/0053; A44C 25/001; A44C 25/004; A44C 25/002; A44C 15/00; A44C 17/02; A44C 17/0241; A44C 17/0258; A44C 17/0266; A44C 17/0275; A41G 1/002

USPC ..... 63/31, 15

See application file for complete search history.

(56) References Cited

U.S. PATENT DOCUMENTS

| | | | | | |
|---|---|---|---|---|---|
| 190,248 | A | * | 5/1877 | Potts | 24/5 |
| 530,870 | A | * | 12/1894 | Wenger | 40/411 |
| 549,039 | A | * | 10/1895 | Wenger | 40/411 |
| 3,365,877 | A | * | 1/1968 | Altman | A44C 17/02 224/170 |

(Continued)

FOREIGN PATENT DOCUMENTS

| | | |
|---|---|---|
| EP | 2070435 A | 6/2009 |
| GB | 790517 | 2/1958 |

*Primary Examiner* — Jack W Lavinder

(74) *Attorney, Agent, or Firm* — Yokoi & Co., U.S.A.; Toshiyuki Yokoi

(57) ABSTRACT

As a new design, when making part of a decoration rotatable, there is a tendency for this to result in an unnecessarily complex structure, and it was difficult to apply such structures to small decorations such as rings, due to considerations such as strength and smooth movement. Solution: The present invention was configured as follows in order to provide a decoration which, even if having a small size, has a simple structure and strength, and opens like a flower. The decoration has a configuration whereby one of a group of movable petals (1) having a calculated curved surface (2) and which are positioned so as overlap with the positions to be rotated and are synchronized with one another, is opened and closed by a single rotating knob (11) and is synchronized with the other petal-shaped parts (1) smoothly and effectively to replicate the movement of a flower opening and closing.

5 Claims, 6 Drawing Sheets

(56) References Cited

U.S. PATENT DOCUMENTS 3,805,549 A * 4/1974 Nielsen ..... A44C 13/00
428/11
5,522,758 A * 6/1996 Liu ..... A63H 13/00
40/411

* cited by examiner

[Fig.1]
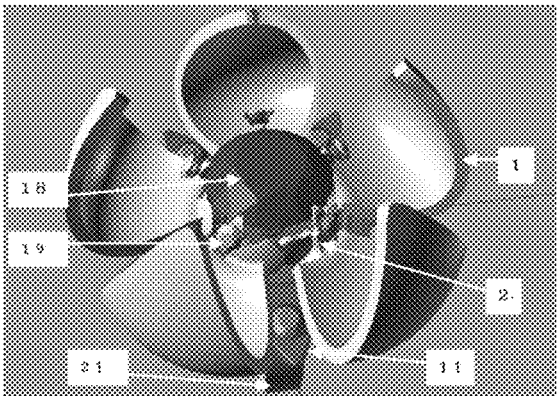
[Fig.2]
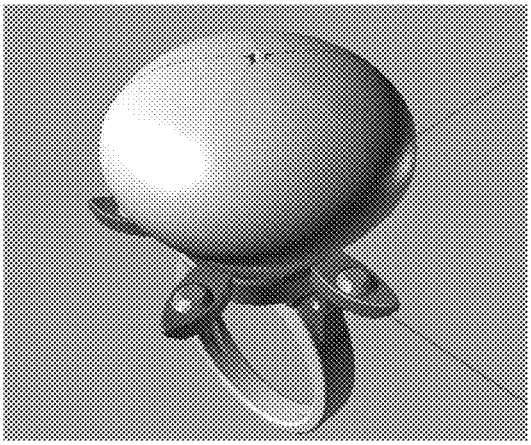
[Fig.3]
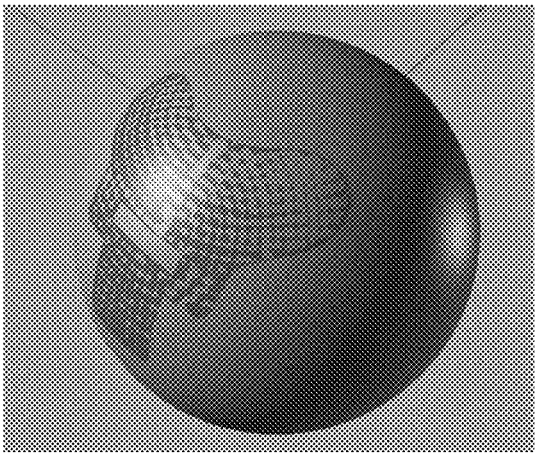

[Fig.4]
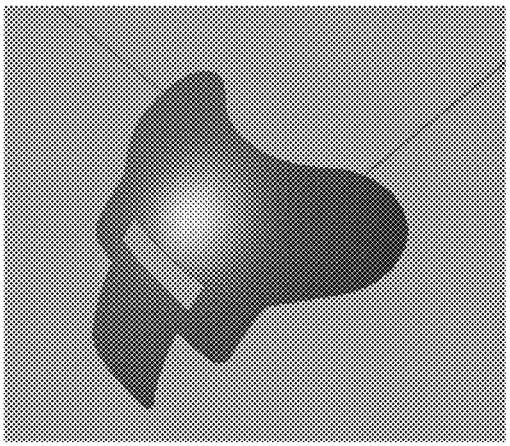
[Fig.5]
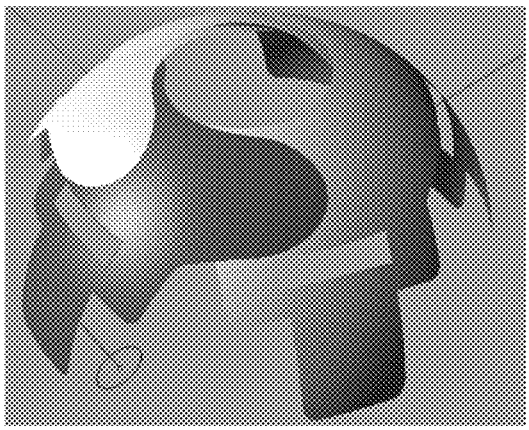
[Fig.6]
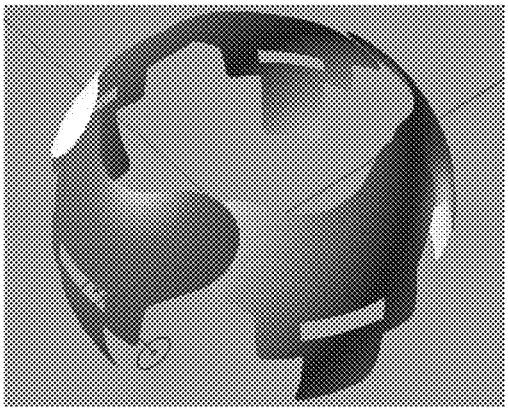

[Fig.7]
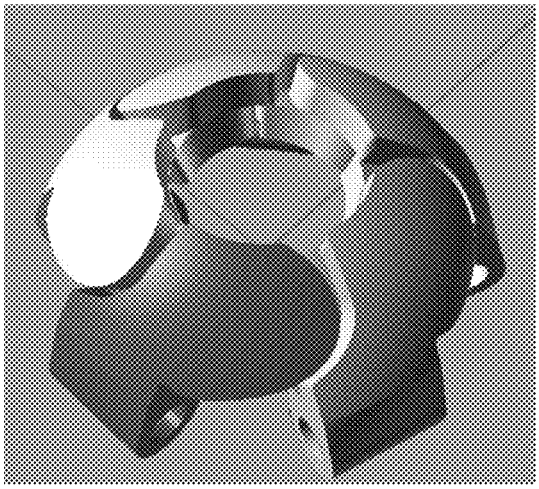
[Fig.8]
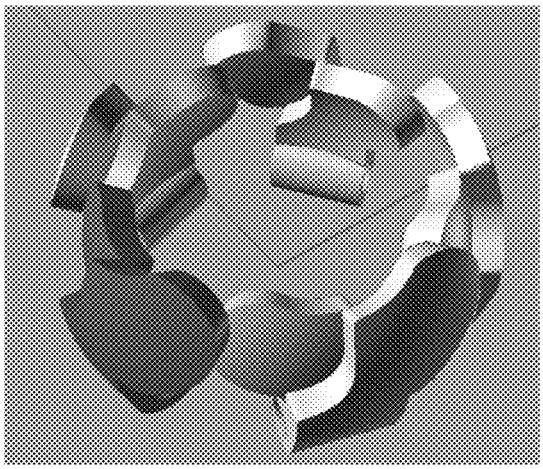

[Fig.9]
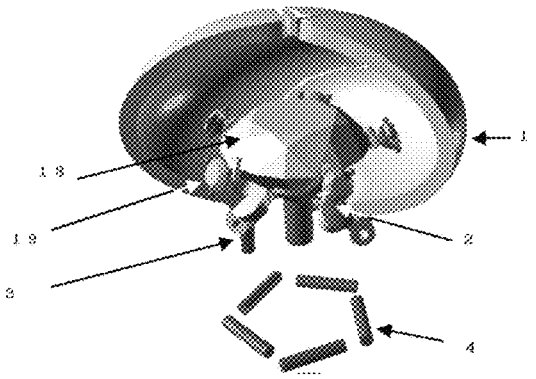
[Fig.10]
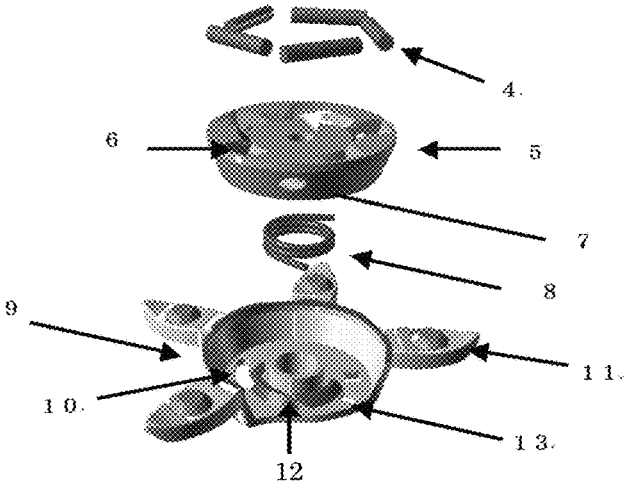
[Fig.11]
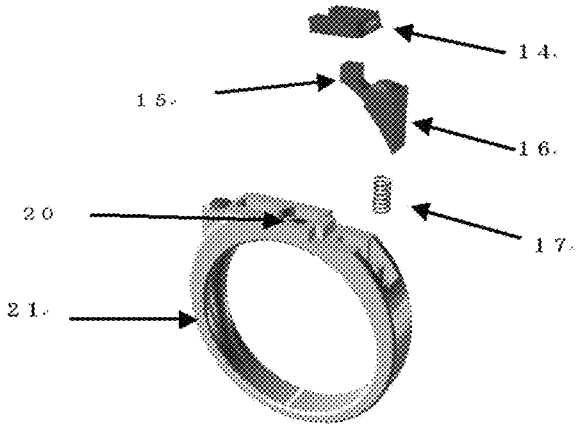

[Fig.12]
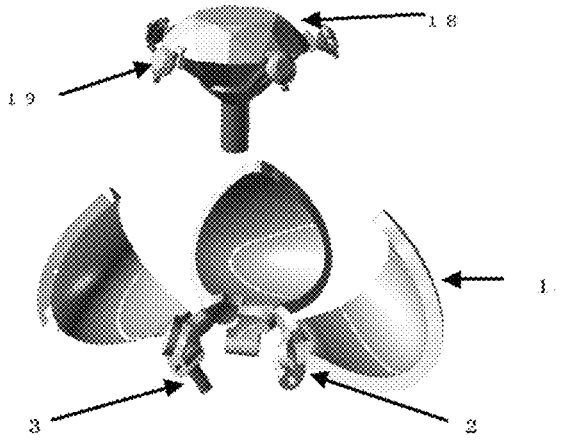
[Fig.13]
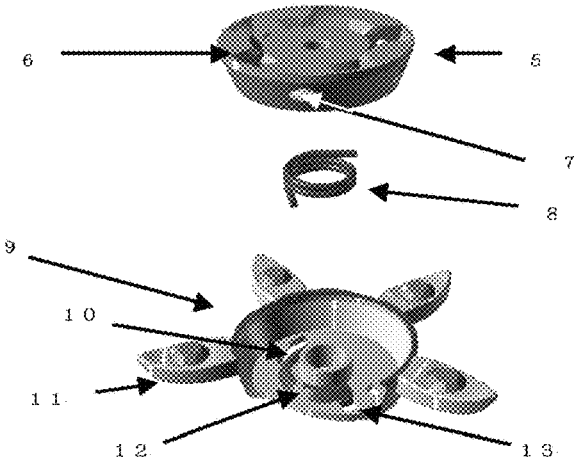
[Fig.14]
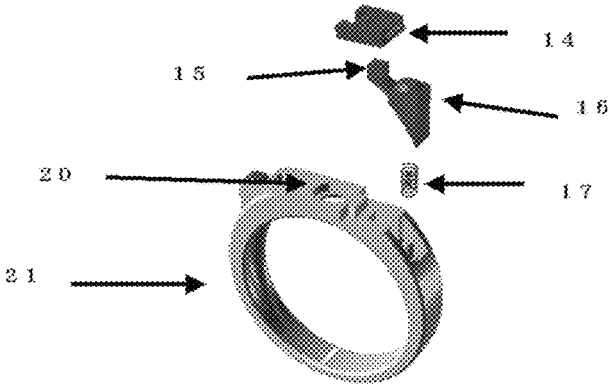

[Fig.15]
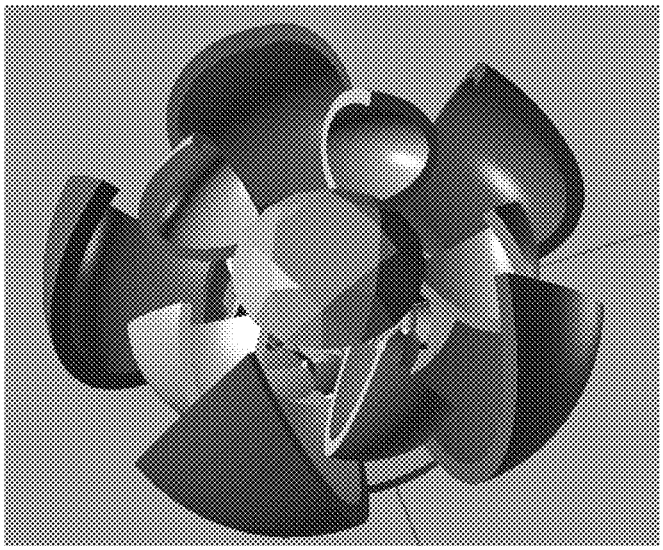

ACCESSORY/DECORATION THAT OPENS LIKE A FLOWER

CROSS-REFERENCES TO RELATED APPLICATIONS

This Application is a Continuation-In-Part application claiming the benefit of priority of the co-pending U.S. Utility Non-Provisional Patent Application No. 14/786,214, with a filing date of Oct. 22, 2015, the entire disclosures of all applications are expressly incorporated by reference in their entirety herein.

BACKGROUND OF THE INVENTION

1. Field of the Invention

This invention is concerned with accessories/decorations equipped with several "Petal Shaped Parts" (1) that open/close like a flower in a simple mechanism.

2. Description of Related Art

With traditional accessories/decorations, they are composed of decorated parts or precious metal/stones which are mostly fixed on the base. Thus the design remains indifferent and is not innovative enough to give a surprise.

In Great Britain Patent Application Publication No. 790517, an accessory having an opening/closing mechanism is disclosed. However, the opening/closing mechanism is complicated and requires many components. Thus, it is difficult to mount the opening/closing mechanism on a small accessory and difficult to design the accessory freely. Furthermore, operation of the opening/closing is not smooth, and maintainability is not sufficient.

In European Patent Application Publication No. 2070435, a vertically displacement mechanism used for an accessory or the like is disclosed. This mechanism also requires many components for realizing the opening/closing mechanism. In addition, each of petal shaped parts is independently moved without being moved synchronously. In this mechanism, the petal shaped parts are driven by merely using the principle of leverage. Thus, the driving mechanism is not new.

BRIEF SUMMARY OF THE INVENTION

As a new design, when making part of a decoration rotatable, there is a tendency for this to result in an unnecessarily complex structure, and it was difficult to apply such structures to small decorations such as rings, due to considerations such as strength and smooth movement.

The present invention was configured as follows in order to provide a decoration which, even if having a small size, has a simple structure and strength, and opens like a flower. The accessory/decoration has: a lower group of a plurality of operation bases arranged in a rotationally symmetric positions; and an upper group of a plurality of petal shaped parts, wherein the operation bases are connected with the petal shaped parts respectively, the operation bases form a spherical surface, each of the operation bases is overlapped with the neighboring operation base at an end portion in the arranged direction of the operation bases to form a rotary opening/closing mechanism, rotation shafts are provided at each of connecting portions between the operation bases and petal shaped parts to be directed in a horizontal tangential direction of the spherical surface, the operation bases have the same shape with each other, and the operation bases are rotatable in a predetermined range around the rotation shaft.

With this invention, open/close mechanism like a flower can be easily adopted to accessory/decoration from small one like a ring to large objects, resulting to allow suppliers to develop innovative design line which gives pleasure and surprise to end user. In the present invention, the rotation mechanism can be achieved by the minimum components. For example, the rotation mechanism of five petals can be achieved only by five petal shaped parts formed integrally with the operation bases. Because of this, weight and manufacturing cost can be reduced. Since each of the operation bases is overlapped with the neighboring operation base at an end portion, the operation bases can be moved synchronously only by moving one of them. Because of this, operation of the opening/closing is smooth, and maintainability is good. Since the operation bases are surface-to-surface contact with each other, the operation bases are difficult to wear and kept long time.

BRIEF DESCRIPTION OF THE DRAWINGS

FIG. 1: Application sample of this invention to a ring—open status

FIG. 2: Application sample of this invention to a ring—close status

FIG. 3: A sphere used as a contacting surface of "Base part of petal shaped parts"

FIG. 4: Original butterfly formed surface clipped from a sphere to create "Base part of petal shaped part" having ideal contacting surfaces FIG. 5: Overlap relation of the butterfly formed surface—close status FIG. 6: Overlap relation of the butterfly formed surface—open status FIG. 7: Completed "Base part of petal shaped parts" after reinforcement is done on the surface thickness closed status FIG. 8: Completed "Base part of petal shaped parts" after reinforcement is done on the surface thickness open status FIG. 9: Structure of a ring with this invention—upper part—open status FIG. 10: Structure of a ring with this invention—middle part—open status FIG. 11: Structure of a ring with this invention—lower part—open status FIG. 12: Structure of a ring with this invention—upper part—close status FIG. 13: Structure of a ring with this invention—middle part—close status FIG. 14: Structure of a ring with this invention—lower part—close status FIG. 15: Application sample of this invention to a brooch in double allocation—open status

DETAILED DESCRIPTION OF THE INVENTION

The decoration has a configuration whereby one of a group of movable petals (1) having a calculated curved surface (2) and which are positioned so as overlap with the positions to be rotated and are synchronized with one another, is opened and closed by a single rotating knob (11) and is synchronized with the other petal-shaped parts (1) smoothly and effectively to replicate the movement of a flower opening and closing.

By inserting a Torsion Spring (8) in the Main Body (5), the Turning Part (9) is released with a touch of Release Button (16) which will change the angle of Pole For Open/Close (3). This open/close movement on the main petal is transferred to other petals by means of smooth surface contacting/pushing each other, resulting to open the total Petal Shaped Parts (1) pivoted by Shaft of Open/Close (4).

If the Turning-Part—Knob (11) is manually turned anti-clockwise direction, the Petal Shaped Parts (1) are closed and fixed when Turning Stopper Head (16), which is kept pushing to upper direction by Pushing Coil Spring (17), reaches to the position of the Turning Part—Receiver of Stopper Head (13).

Center cut stone (18) and Mele diamonds (19) are arranged, for example, to increase a performance effect when the flower is opened.

Please refer to FIG. 1 (open status) and FIG. 2 (close status) as an application to a ring.

Please refer to FIG. 15 (in double allocation—open status) as an application to a brooch.

An accessory/decoration of the present invention is comprised of: petal shaped parts 1; shafts 4 for open/close; a main body 5; a torsion spring 8; a turning part 9; a cap 14 for turning stopper; a turning stopper 15; a pushing coil 17 of turning stopper release button; a center cut stone 18; mele diamonds 19; and an ornament (ring) 21.

The petal shaped parts 1 have a hollow shape, for example, formed in a shape of a flower bud. The petal shaped parts 1 divide an outer shell of a three dimensional shape having an axisymmetric shape into a plurality of parts so that each of the petal shaped parts 1 has the same shape as the other parts. The petal shaped parts 1 shown in FIG. 1 and FIG. 2 have a shape linearly divided into equal angles from an apex. Since the basic shape is a closed three dimensional shape having an axisymmetric shape, the original shape of the flower bud can be reproduced by joining all of the divided petal shaped parts 1 with each other. Accordingly, if the top sides are opened while the bottom sides remain close to each other, the petal shaped parts 1 look like as if petals are opened. The closed shape of the flower bud is not necessarily constant. For example, the closed shape can be a spherical shape, a shape of a cigar having an approximately elongated shape closed at both top and bottom ends, and a shape of a gourd.

Note that the outer shell formed by a plurality of petal shaped parts 1 is not necessarily closed. The top sides can be open, for example. As explained above, the petal shaped parts 1 can be freely designed. Although the number of the petal shaped parts 1 is five in the present embodiment, the number of the petal shaped parts 1 can be increased and decreased. However, if the number of petal shaped parts 1 is too many, a size of each of the parts becomes too small. On the other hand, if the number of petal shaped parts 1 is too small, the petal shaped parts 1 is easily interfered with an object housed in the petal shaped parts 1 when opening the petal shaped parts 1 while the object is held. Hence, the number of petal shaped parts 1 is preferably four or more and approximately five to eight, for example.

FIGS. 3-8 show operation bases 2 (bases of the petal shaped parts for open/close) for operating the petal shaped parts.

The operation bases 2 are formed at an end portion near the bottom side of the petal shaped parts 1 shown in FIG. 1 and FIG. 2.

The petal shaped parts 1 are opened and closed with the bottom side as a center. Therefore, one shaft 4 is provided at each of connecting portions between each of the operation bases 2 and petal shaped parts 1. Five shafts (rotation shafts) 4 are arranged so as to form an approximately regular pentagon. Thus, the operation bases 2 are formed near the bottom side of the petal shaped parts 1. The shafts 4 are directed in a tangential direction of a circle around which the regular pentagon is circumscribed. Namely, the shafts 4 are directed in a horizontal tangent direction of the spherical surface.

A shaft hole is formed on each of the operation bases 2 to insert the shaft 4 through the shaft hole. The shafts 4 are arranged to form a shape of an approximately regular pentagon. Each of the petal shaped parts 1, which are connected with the operation bases 2 is rotated with the shafts 4 as the rotational axis. When the petal shaped parts 1 are rotated, the bottom side of the petal shaped parts 1 is served as a supporting point. Accordingly, the top portions of the petal shaped parts 1 are rotated so as to move in a circular arc.

The petal shaped parts 1 and the operation bases 2 are integrally formed. The petal shaped parts 1 form the top portion, and the operation bases 2 form the bottom portion. The operation bases 2 have a shape expanded in the width direction as explained later. The operation bases 2 are also referred to as bottom wings. The bottom wings form a rotary opening/closing mechanism rotated around a horizontal tangent direction of the petal shaped parts 1. The operation bases 2 are arranged in a rotationally symmetric positions, and have the same shape with each other. The operation bases 2 are overlapped with each other to form a spherical surface. In each of the operation bases 2, a left wing portion (left portion of the bottom wing) is located at a lower part of a right wing portion (right portion of the bottom wing) of the neighboring bottom wing. In other words, operation bases 2 are overlapped with each other so that the lower surface of the right wing is in contact with the upper surface of the left wing. In the present invention, the laterally expanded wing shape is referred to as the left wing and the right wing. This shape is referred to as a butterfly shape for the sake of convenience of explanation.

As explained above, the operation bases 2 are overlapped with each other to form a spherical surface so that the lower surface of the right wing is in contact with the upper surface of the left wing. Accordingly, when one of the operation bases 2 is moved to close the petals, the right wing of the operation base 2 pushes the neighboring operation base 2 from the upper surface to the inside. Furthermore, the right wing of the pushed operation base 2 pushes the neighboring operation base 2 from the upper surface to the inside. Thus, the movement is transferred. Consequently, all of the operation bases 2 move in the closing direction. The movement of the operation bases 2 is converted into the rotation movement of the shafts 4 to close the petal shaped parts 1.

On the other hand, when one of the operation bases 2 is moved to open the petals, the left wing of the operation base 2 pushes the neighboring operation base 2 from the lower surface to the outside. Furthermore, the left wing of the pushed operation base 2 pushes the neighboring operation base 2 from the lower surface to the outside. Thus, the movement is transferred. Consequently, all of the operation bases 2 move in the opening direction. The movement of the operation bases 2 is converted into the rotation movement of the shafts 4 to open the petal shaped parts 1. Thickness of the operation bases 2 is reinforced at a portion overlapped with the neighboring operation base 2 to increase the strength of the outer shell.

The rotation mechanism is formed by the operation bases 2. When the operation bases 2 are rotated with the shafts 4 as a shaft center, a group (2) of the operation bases and a group (1) of the petal shaped parts are synchronously rotated. Since the operation bases 2 are formed to divide a spherical surface, the opening/closing operation can be transferred certainly and smoothly.

Although the operation bases 2 can be formed to divide a spherical surface as shown in FIG. 3 and FIG. 4, a spherical surface is not necessarily formed. Each of the operation bases 2 is overlapped with the neighboring operation base 2 at an end portion in the arranged direction of the operation bases. When the operation bases 2 are overlapped, at both end sides of the rotation axis, an end portion of one operation base 2 is located at an upper surface of the other end portion of the neighboring operation base 2. Since a plurality of operation bases 2 are annularly (spherically) arranged, the movement of one of the operation bases 2 can be transferred to all of the operation bases 2.

On only one of five petal shaped parts 1, a pin-shaped pole 3 for open/close is projected approximately vertically downward from the operation base 2. When the tip side of the pin-shaped pole 3 for open/close is moved closed to the shaft center of five petal shaped parts 1, the petal shaped parts 1 are opened. On the other hand, when the tip side is moved separate from the shaft center of five petal shaped parts 1, the petal shaped parts 1 are closed.

In the preset embodiment, one spherical surface is divided into a butterfly shape (FIG. 3), the rotation mechanism (pole 3) is formed on a lower surface of the bottom wing to be rotated around the shafts 4 which are directed in a horizontal tangent direction, and a plurality of operation bases 2 (FIG. 5) are provided so that the lower surface of the right wing is in contact with the upper surface of the left wing on the spherical surface. In addition, the petal shaped parts 1 connected respectively with the operation bases 2 (FIG. 12) are provided. When one of the operation bases 2 is rotated by the rotation mechanism (pole 3) formed on the lower part of the bottom wing, the rotation movement of one of the petal shaped parts 1 formed integrally with one of the operation bases 2 is synchronously transferred to all operation bases 2 and petal shaped parts 1 surely and smoothly. Consequently, the group (1) of petal shaped parts 1 as a whole changes the shape as if the flower is opening/closing.

The main body 5 is formed in a disk shape having a certain thickness and arranged below the operation bases 2. A receiver 7 of shaft is formed on the main body 5 to rotatably house five shafts 4 at both end portions so that a regular pentagon is formed in an approximately horizontal plane. Since each of the shafts 4 penetrates through the operation base 2 and rotatably supports the operation base 2, a receiver 6 of base of petal is formed on the main body 5 so that the operation bases 2 are rotatable within a predetermined range around the shafts 4. Furthermore, since the pin-shaped pole 3 for open/close is projected vertically downward from one of the operation bases 2, a hole to penetrate the pole 3 for open/close through is also formed.

The turning part 9 is formed in a shallow plate shape to rotatably house the disk-shaped main body 5. The turning part 9 is arranged below the main body 9 to rotate some of the operation bases 2 around the shafts 4 so that a shape of the petal shaped parts 2 as a whole is changed as if petals are opened and closed. The torsion spring 8 is housed between the turning part 9 and the main body 5. One end of the torsion spring 8 is engaged with the main body 5, and the other end is engaged with a receiver 12 of torsion spring formed on the turning part 9. The torsion spring 8 applies rotation force to the turning part 9 counterclockwise with respect to the main body 5. The explanation of the engaged portion is omitted because the engaged portion has a general shape to apply the rotation force by the torsion spring.

Five rotating knobs 11 are formed at equal angular intervals from a periphery of the turning part 9 approximately outward in the horizontal direction. The rotating knobs 11 extend outward so as to be operable as a knob. The shape of the rotating knobs 11 can be arbitrarily changed. An angle control gap 10 of pole is formed on an inner bottom surface of the shallow plate shaped turning part 9. The angle control gap 10 has a circular arc shape to penetrate in the vertical direction. The angle control gap 10 of pole is actually formed in a part of a spiral, not the circular arc shape. The pole 3 for open/close is inserted into the angle control gap 10 of pole to form a cam mechanism by them. The pin is inserted into the hole forming the spiral. When the side of the spiral is rotated, the pin is moved in the radial direction. Namely, when the turning part 9 is rotated, the angle control gap 10 of pole is also rotated. Consequently, the pole 3 for open/close is moved close to the shaft side or separate from the shaft side. As a result, the petal shaped parts 1 are opened or closed.

The main body 5 is screwed and fixed to a main body receiver 20 formed at an upper part of the ornament (ring) 21. The turning part 9 can be rotated within a predetermined angle range between the main body 5 and the ornament 21. In the ornament 21, a recess is formed at a portion below the turning part 9. The turning stopper 15 and the pushing coil 17 of turning stopper release button are housed in the recess. In the turning stopper 15, a portion located upper than the pushing coil 17 of turning stopper release button functions as a turning stopper release button 16. The cap 14 for turning stopper is attached to cover the portion nearer to the rotation axis of the turning part 9 than the turning stopper release button 16. Namely, the turning stopper 15 is held between the recess of the ornament 21 and the cap 14 for turning stopper, and the turning stopper 15 is pushed upward by the pushing coil 17 of turning stopper release button. The turning stopper 15 faces the lower surface of the turning part 9. Two receivers (holes) 13 of stopper head are formed at the bottom surface of the turning part 9. As explained above, the positions of two receivers 13 of stopper head are specified so that the receivers 13 face the turning stopper 15 respectively at the opened position and the closed position of the petal shaped parts 1 when the turning part 9 is rotated. At the facing position, the tip of the turning stopper 15 is inserted into one of the receivers 13 of stopper head. Although the rotating biasing force is applied to the turning part 9 by the torsion spring 8, the position of the turning part 9 is held when the tip of the turning stopper 15 is inserted into one of the receivers 13 of stopper head. Since the pole 3 for open/close is inserted into the angle control gap 10 of pole, the range of rotating the turning part 9 is restricted by the shape of the angle control gap 10 of pole.

In the above described configuration, five petal shaped parts 1 are initially closed. In this state, although the turning part 9 receives the maximum rotating biasing force from the torsion spring 8, the position of the turning part 9 is held because the tip of the turning stopper 15 is inserted into one of the receivers 13 of stopper head and locked. Thus, the rotation of the turning part 9 is prohibited. In addition, the petal shaped parts 1 are held at the closed position.

From this state, the turning stopper release button 16 supported on the ornament 21 is pushed down against the biasing force of the pushing coil 17 of turning stopper release button. Because of this, the turning stopper 15 is released from the receiver 13 of stopper head and the turning part 9 is rotated by receiving the biasing force of the torsion spring 8. Thus, the rotation of the turning part 9 is allowed. Consequently, the pole 3 for open/close, which forms the cam mechanism together with the angle control gap 10 of pole, receives the driving force to be pulled toward the shaft center of the turning part 9. Thus, five petal shaped parts 1 are driven to open the petals. When the petal shaped parts 1 are completely opened, the turning stopper 15 faces the other of the receivers 13 of stopper head. Thus, the turning stopper 15 is inserted into the receiver 13 of stopper head and locked.

When closing the petal shaped parts 1, the turning stopper release button 16 is pushed down against the biasing force of the pushing coil 17 of turning stopper release button and then the turning part 9 is rotated in the direction opposite to the direction when the petal shaped parts 1 are opened. Consequently, the pole 3 for open/close, which forms the cam mechanism together with the angle control gap 10 of pole, receives the driving force to be separated from the shaft center of the turning part 9. Thus, five petal shaped parts 1 are closed. When the petal shaped parts 1 are completely closed, the turning stopper 15 faces the one of the receivers 13 of stopper head. Thus, the turning stopper 15 is locked.

FIG. 15 shows an example that petals are doubled. In main body 5, shafts are doubly arranged in an inside and an outside so that petals are arranged in the inside and the outside. In the turning part, the angle control gaps are formed to be located at the inside and the outside so that the petals of the inside and the outside can be opened and closed.

Namely, a plurality of groups of operation bases 2 and petal shaped parts 1 having different sizes are arranged in a nested structure so that one of the groups is continuously surrounded by the other of the groups (FIG. 15). Thus, a plurality of petals are opened and closed.

As explained above, the group of the operation bases 2 and the group of the petal shaped parts 1 connected respectively with the operation bases 2 are surrounded by another group of operation bases 2 and another group of the petal shaped parts 1 connected respectively with the operation bases 2. Thus, an effect as if a plurality layers of petals are opened and closed can be obtained.

INDUSTRIAL APPLICABILITY

This invention is applicable to Accessories/Decorations/Objet/Package etc.

Thanks to the simple mechanism realized by this invention, open/close function replicating a flower movement becomes applicable easily throughout the accessories/decorations from small one like rings to big one including brooches, table ornaments, thus helping suppliers to create new design line with which pleasure and surprise can be conveyed to the end user.

REFERENCE SIGNS LIST

1 Petal shaped parts
2 Base of petal shaped parts for open/close (Operation base)
3 Pole for open/close
4 Shaft for open/close
5 Main body
6 Main body—Receiver of base of petal
7 Main body—Receiver of shaft
8 Torsion spring
9 Turning part
10 Turning part—Angle control gap of pole
11 Turning part—Knob
12 Turning part—Receiver of torsion spring
13 Turning part—Receiver of stopper head
14 Turning part—Cap
15 Turning stopper head
16 Turning stopper release button
17 Pushing coil of turning stopper release button
18 Center cut stone
19 Mele diamonds
20 Receiver of main body
21 Ornament (Ring)

What is claimed is:

1. An accessory/decoration, comprising:
a lower group of a plurality of operation bases arranged in a rotationally symmetric positions; and
an upper group of a plurality of petal shaped parts, wherein
the operation bases are connected with the petal shaped parts respectively,
the operation bases form a spherical surface,
each of the operation bases is overlapped with the neighboring operation base at an end portion in the arranged direction of the operation bases to form a rotary opening/closing mechanism,
rotation shafts are provided at each of connecting portions between the operation bases and petal shaped parts to be directed in a horizontal tangential direction of the spherical surface,
the operation bases have the same shape with each other, and
the operation bases are rotatable in a predetermined range around the rotation shaft.

2. The accessory/decoration according to claim 1, wherein
a thickness of the operation bases is reinforced at a portion overlapped with the neighboring operation base.

3. The accessory/decoration according to claim 1, wherein the group of the operation bases and the group of the petal shaped parts having different sizes are arranged in a nested structure so that one of the groups is continuously surrounded by the other of the groups to obtain an effect as if a plurality layers of petals.

4. The accessory/decoration according to claim 1, wherein
a main body is arranged below the operation bases to rotatably house the operation bases,
a turning part is arranged below the main body to rotate some of the operation bases around the rotation shaft so that a shape of the petal shaped parts as a whole is changed as if petals are opened and closed.

5. The accessory/decoration according to claim 4, wherein
a torsion spring is arranged between the turning part and the main body to apply a rotating biasing force to the turning part,
a turning stopper release button is arranged to prohibit and allow a rotation of the turning part,
the petal shaped parts can be locked in a state that petals are closed by rotating a knob formed at a periphery of the turning part and pushing the turning stopper release button, and
the petal shaped parts can be opened by releasing the turning stopper release button to rotate the rotating part by the rotating biasing force.

* * * * *